US005924470A

United States Patent [19]

Costilla-Vela et al.

[11] Patent Number: 5,924,470

[45] Date of Patent: Jul. 20, 1999

[54] METHOD FOR PREHEATING MOLDS FOR ALUMINUM CASTINGS

[75] Inventors: Onofre Costilla-Vela, Nuevo Leon; Salvador Valtierra-Gallardo, Coahuila; Oscar Garza-Ondarza, Nuevo León, all of Mexico

[73] Assignee: Tendora Nemak, S.A. de C.V., Garcia, Mexico

[21] Appl. No.: 08/739,125

[22] Filed: Oct. 28, 1996

Related U.S. Application Data

[60] Provisional application No. 60/005,998, Oct. 27, 1995.

[51] Int. Cl.[6] ..... B22D 27/04; B22D 37/00; B22D 46/00

[52] U.S. Cl. ..... 164/4.1; 164/121; 164/122; 164/151.4; 164/155.6; 164/457

[58] Field of Search ..... 164/457, 4.1, 151.4, 164/155.6, 121, 122

[56] References Cited

U.S. PATENT DOCUMENTS

| | | | |
|---|---|---|---|
| 361,198 | 4/1887 | Wheeler . | |
| 1,336,234 | 4/1920 | Jamison . | |
| 2,892,224 | 6/1959 | Bauer . | |
| 3,620,294 | 11/1971 | Hetzel et al. | 164/155.4 |
| 3,633,648 | 1/1972 | Barrow et al. | 164/127 |
| 4,574,867 | 3/1986 | Thompson | 164/113 |
| 5,125,448 | 6/1992 | Jensen | 164/155.1 |

FOREIGN PATENT DOCUMENTS

| | | | |
|---|---|---|---|
| 58-138558 | 8/1983 | Japan . | |
| 63-157751 | 6/1988 | Japan | 164/457 |
| 1-91960 | 4/1989 | Japan | 164/457 |
| 2-46963 | 2/1990 | Japan | 164/457 |
| 2-258139 | 10/1990 | Japan | 164/457 |
| 662264 | 5/1979 | U.S.S.R. | 164/155.6 |
| 854576 | 8/1981 | U.S.S.R. | 164/122 |
| 1026946 | 7/1983 | U.S.S.R. . | |
| 2246532 | 2/1992 | United Kingdom | 164/4.1 |

OTHER PUBLICATIONS

*Foundry Technology*, American Society for Metals, pp. 42, 44, 45, 1982.

*Metals Handbook*, 9th Edition, vol. 15 Casting, pp. 280–283, 1988.

Abstract of Japanese Patent Publication 56–19967 Published Feb. 25, 1981.

Abstract of Japanese Patent Publication 57–124566 Published Aug. 3, 1982.

Abstract of Japanese Patent Publication 2–160159 Published Jun. 20, 1990.

*Primary Examiner*—J. Reed Batten, Jr.

*Attorney, Agent, or Firm*—Frommer Lawrence & Haug LLP; A. Thomas S. Safford

[57] ABSTRACT

Aluminum parts are cast in a plurality of permanent-type or semi-permanent-type molds, the molds being preheated to a predetermined temperature before starting the casting operation, and being provided with temperature sensors and a logic device which produces a blocking signal for the casting system when the temperature of the mold is below a predetermined casting temperature in order to minimize the number of scrap castings due to uneven or low mold temperature. Hot gases are created and flowed through the interior of the mold, by a burner and hood shaped to fit over at least some mold openings.

9 Claims, 2 Drawing Sheets

METHOD FOR PREHEATING MOLDS FOR ALUMINUM CASTINGS

RELATED APPLICATION

This application claims the benefit of U.S. Provisional Application 60/005,998, filed Oct. 27, 1995.

FIELD OF THE INVENTION

The present invention relates to an improved method and apparatus for the production of aluminum alloy castings. More particularly, to a method and apparatus for preheating molds right in their operational position within the casting system in order to reduce the amount of scrap castings produced by current methods thereby raising the productivity of the casting process and lowering the production costs by minimizing the scrap resulting from uneven or low temperatures in some of the molds.

BACKGROUND OF THE INVENTION

Production of aluminum alloy castings, for example massive production of automobile engine parts, is usually made in permanent-type or semi-permanent type molds, in contrast with molds made of sand which are used for only one casting and are destroyed when the casting is extracted therefrom. The permanent or semi-permanent molds are provided with cooling means which accelerate the solidification process of a casting thus raising the productivity of the casting plant. Whenever the molds are taken out of operation, and have to be used again, or the casting system undergoes delays, the temperature in several portions of the mold drops down and may cause premature solidification of the liquid aluminum. This situation may result in a number of castings of poor quality due to uneven casting flow and solidification or the like, producing costly scrap and time loss with consequent expensive labor and product losses. It has been customary to preheat the molds at the beginning of a casting cycle by means of natural gas-air burners which throw a flame directly over the walls of the mold in order to have some higher temperatures in the mold walls. This preheating however is done without any specific control, and is based on the experience of the operators. The current casting practices do not provide any means or method for assuring that the casting to be made in a given mold will be of good quality without defects due to having been cast in a mold with an uneven temperature distribution or simply an overall lower temperature not suitable for a good quality casting. In spite of such grossly-applied preheating of cold molds, it is common in the art of manufacturing aluminum castings that a certain percentage (commonly as much as 2 to 4%) of the production is accepted as scrap production, because at start up the aluminum is cast in an effectively still "cold" mold (thus, functioning eventually to heat the molds to effective operating temperature, but in the interim producing so-called "warm-up" scrap).

The present invention is related to a method and apparatus for preheating the molds so that no scrap due to this problem is produced and its practice results in savings of millions of dollars per year in a given casting plant.

OBJECTS AND SUMMARY OF THE INVENTION

It is therefore an object of the invention to provide a process of manufacturing aluminum alloy castings with improved productivity and at lower scrap rate.

It is another object of the invention to provide a method and apparatus for casting aluminum parts which assure that the casting will not be produced with defects due to unsuitable temperature in the molds.

Other objects of the invention will be in part obvious and in part pointed out hereinafter.

According to the present invention the objects thereof are achieved by providing a method and an apparatus of the surprisingly simple, but heretofore unappreciated expedient, of preheating molds for manufacturing aluminum alloy castings by flowing hot gases internally throughout the molds, such invention comprising providing a mold having a cavity with the form of the casting to be manufactured and a plurality of passages for conduction of liquid aluminum so as to fill said cavity, producing a high temperature flame by the combustion of a fuel with air having a length such as not to impinge directly on said mold in a manner to cause excessive hot spots within the mold, guiding the hot combustion products of said flame through all the convolutions of cavity of said mold including said passages; obtaining at least one signal indicative of the temperature at at least one representative portion of the internal surface of said mold, which one or more signals are effective to reliably sense that the internal mold temperatures are high enough to yield good quality castings; comparing said signal with a predetermined range of values of temperature and filling said mold with liquid aluminum only after the value of said temperature signal falls within said predetermined range of values.

The invention also comprises an apparatus for preheating casting molds for manufacturing aluminum castings, which apparatus comprises: a mold having a cavity shaped to a form to yield the desired casting and adapted to be filled with liquid aluminum alloys via auxiliary passages, said mold having at least one temperature sensor mounted on said mold with its sensing point at the internal surface of said mold. Said apparatus further including a burner and hood combination fitted to cover sufficient openings in said mold to force hot combustion products throughout the mold's interior and heat the surfaces thereof to acceptable casting temperatures.

BRIEF DESCRIPTION OF THE DRAWINGS

In this specification and in the accompanying drawings, some preferred embodiments of the invention are shown and described and various alternatives and modifications thereof have been suggested; but it is to be understood that these changes and modifications can be made within the scope of the invention. The suggestions herein are selected and included for purposes of illustration in order that others skilled in the art will more fully understand the invention and the principles thereof and will thus be enabled to modify it in a variety of forms, each as may be best suited to the conditions of a particular use.

DETAILED DESCRIPTION OF A PREFERRED EMBODIMENT OF THE INVENTION

Figure 1:
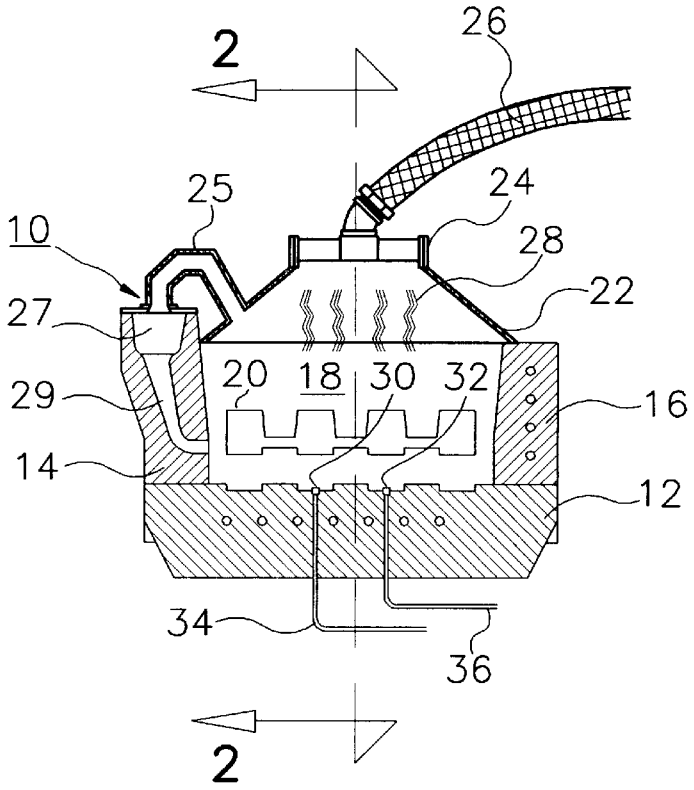
FIG. 1 is a schematic diagram in a longitudinal vertical section of a mold provided with temperature sensors and a burner showing apparatus illustrating a preferred embodiment of the invention adapted to carry out the process steps for producing aluminum castings with minimum scrap.
Figure 2:
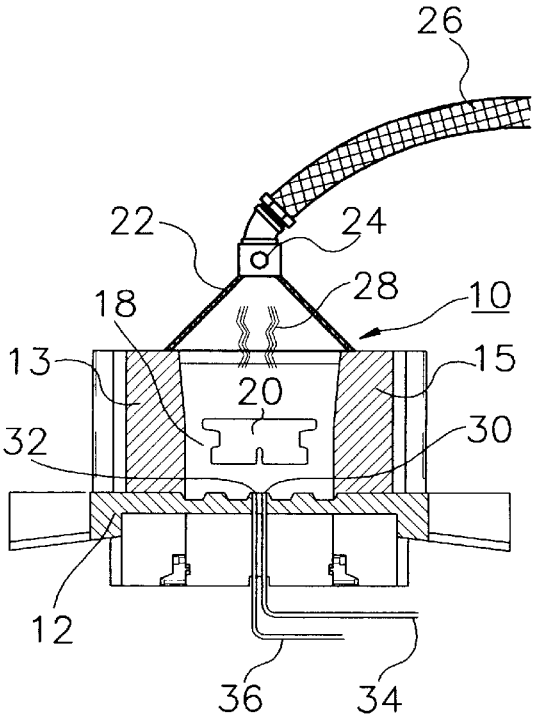
FIG. 2 is schematic diagram in a lateral vertical section of the mold and burner taken along line 2—2 in FIG. 1.
Figure 3:
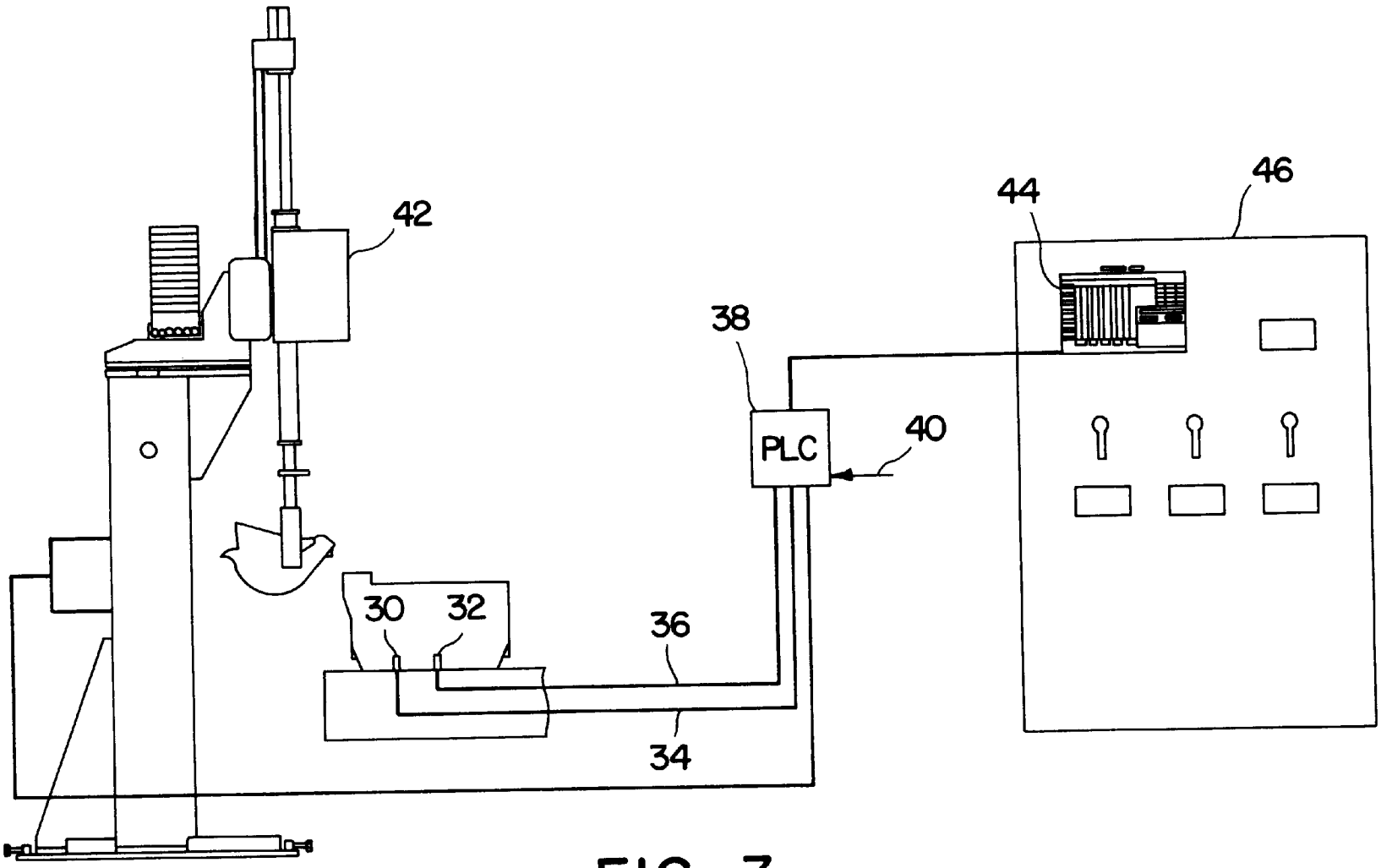
FIG. 3 is a schematic diagram of the control system for assuring that the mold is suitably preheated before said mold is filled with liquid aluminum.

Referring now to FIG. 1, showing a schematic diagram of a mold which may take a variety of forms, numeral 10 generally designates a semi-permanent mold made of steel comprising a bottom portion 12 and lateral portions 14 and 16 (the other wall portions 13 and 15 of the mold being illustrated in FIG. 2). The mold wall portions enclose a cavity 18 where the casting will be formed, and where usually cores of sand 20 are placed in order to obtain the final desired shape of the casting. The mold 10 is generally a complex piece of equipment and has electrical, mechanical and thermal systems in order to perform the casting process in a controlled sequence and with a high productivity.

Quality defects, with the consequent losses in productivity of a casting system, occur when the mold is filled with liquid aluminum alloy and the mold is not at the proper temperature to receive the liquid aluminum in all of the internal walls of its casting volume. It may occur that the aluminum becomes solid at some of the mold channels leading to the casting volume and therefore the casting is not completely full. It may also occur that the upper portion of the mold is cooler than the bottom portion and the casting solidifies at the top portion instead of undergoing the controlled solidification from the bottom, whereby the volume of the solid aluminum which is smaller than the volume of liquid aluminum is made up from the excess aluminum filling the top portion of the casting, thus resulting in defects in the lower portions of such casting.

The above mentioned quality problems are minimized or fully eliminated by carrying out the appropriate preheating schedule of the molds according to the present invention. Referring to FIGS. 1 and 2, the mold 10 is covered at its upper portion by a steel cover 22 of a suitable shape to avoid escape of the fumes from the burner and also to avoid heat losses by radiation to the environment from the inner walls of the mold. A conduit 25 communicates the inner side of the cover 22 with the casting cup 27 and its respective runners 29 in order to distribute heat from said burners to the runners through which the liquid aluminum is to flow when filling the mold.

A burner 24, located on said cover 22, fed with natural gas and air by suitable hoses 26, projects short flames 28, so that in this illustrated embodiment the flames with too hot products of combustion do not impinge directly on the inner surfaces of the mold thus preventing the formation of hot spots in said surfaces. At least one temperature sensor 30 is located advantageously at the bottom surface (of the mold) for reading the temperature thereof and to provide a signal which can be read by a programmable controller or by an operator, to determine whether or not the mold is at the right temperature for casting. In order to assure that the casting operation is performed only at the right temperature for the mold, a signal indicative of the temperature is transmitted through wires 34 (preferably together with a back-up 36 signal from a second sensor 32) to a programmable logic controller (PLC) 38 or other equivalent device to which a range of temperatures 40 is specified in the form of a lower limit and an upper limit allowable for performing the casting operation for example, a temperature range of 200° C. to 350° C. With regard to the aforesaid upper limit of the temperature range, one can obtain a signal corresponding to the temperature of the wall of said mold and feed said signal to a programmable logic controller or similar device to produce a separate signal and use said separate signal for controlling the cooling system of said mold. PLC 38 in response to a proper temperature reading produces a signal which allows robot arm 42, used to fill the mold with liquid aluminum, to operate (otherwise blocking operation of said robot 42 in the absence of a proper temperature indication). A visible signal for the operator can be shown with a suitable display 44 in an operation panel 46. This system saves millions of dollars per year avoiding scrap castings with defects caused by filling molds off the casting temperature.

Usually a casting system comprises several molds mounted on a rotating table which positions each mold at the corresponding position for each process operation, such as cleaning, cores setting, casting, and extraction of the casting. It will be evident however that the preheating of molds can be readily applied to other casting systems of fixed or moving molds.

From the foregoing description, it should be apparent that the present invention provides a process and apparatus capable of achieving the several objectives set forth above, and that it solves a long and widely accepted problem which is taken as inherent to currently operating casting plants that scrap castings are unavoidable when there are delays in the casting system and when a new cycle of production is started-up with "cold" molds.

Although the invention has been exemplified as applied to a semi-permanent mold with sand cores, the invention is readily applicable to other types of molds. It is of course to be understood that the foregoing description is intended to be illustrative only and that numerous changes can be made in the structure of the system described and its operating conditions without departing from the spirit of the invention as defined in the appended claims.

What is claimed is:

1. A method of producing aluminum alloy castings in a mold having internal wall surfaces which define a casting cavity, in the form of at least a portion of the casting to be manufactured, and conduits for filling said casting cavity with liquid aluminum alloy, at least a portion of said surfaces initially being too cool for good quality casting, said method comprising:

producing at least one first signal, indicative of the temperature of at least one temperature representative portion of the internal surfaces of said mold;

comparing said signal with at least one second signal which latter signal is indicative of a set temperature high enough to yield good quality castings from the mold;

pre-heating the mold when said first signal corresponds to a temperature below the temperature corresponding to said second signal by producing a flame in a burner located adjoining said cavity by combustion of a fuel with air to preheat said mold before said aluminum alloy is cast in said mold, and by causing the products of combustion of said burner by means of a hooded cover to flow across and heat said internal surfaces of said cavity and conduits, and filling said mold with said liquid aluminum alloy only when said first signal corresponds to a temperature above the temperature corresponding to said second signal.

2. A method of producing aluminum alloy castings according to claim 1, further comprising producing two first signals indicative respectively of the temperature of two different points in said internal wall surfaces of said mold and using said two signals for comparing to said second signal to allow the casting operation in said mold only if both correspond to a temperature above the temperature corresponding to said second signal.

3. A method of producing aluminum alloy castings according to claims 1 or 2, wherein the second signal corresponds to a temperature of between 200° C. to 350° C.

4. A method for producing aluminum alloy castings in a mold also excluding a cooling system, according to one of claims 1 or 2, further comprising obtaining a signal corresponding to the temperature of the wall of said mold; feeding said signal to a programmable logic controller or similar device to produce a separate signal and using said separate signal for controlling the cooling system of said mold.

5. A method for producing aluminum alloy castings according to one of claims 1 or 2, further comprising fitting said burner and hooded cover sufficiently to cover openings in said mold to force hot combustion products throughout the casting cavity of the mold and heat the surfaces thereof to the elevated temperatures effective for producing good quality castings from the mold.

6. A method for producing aluminum alloy castings according to claim 3, further comprising fitting said burner and hooded cover sufficiently to cover openings in said mold to force hot combustion products throughout the casting cavity of the mold and heat the surfaces thereof to the elevated temperatures effective for producing good quality castings from the mold.

7. A method for producing aluminum alloy castings according to claim 4, further comprising fitting said burner and hooded cover sufficiently to cover openings in said mold to force hot combustion products throughout the casting cavity of the mold and heat the surfaces thereof to the elevated temperatures effective for producing good quality castings from the mold.

8. A method for producing aluminum alloy castings according to one of claims 1 or 2, wherein at least one first signal derives from a temperature sensor in the bottom internal casting cavity surface of the mold.

9. A method of preheating molds for manufacturing aluminum alloy castings by flowing hot gases internally throughout the internal wall surfaces of such molds, said method comprising:

providing a mold having a cavity with the form of at least a portion of the casting to be manufactured including a plurality of passages for conduction of liquid aluminum for filling the remainder of said cavity, producing a high temperature flame by the combustion of a fuel with air having a length such as not to impinge directly on said mold in a manner to cause excessive hot spots within the mold, guiding the hot combustion products of said flame along the convolutions of the cavity of said mold including said passages;

obtaining at least one signal indicative of the temperature of at least one representative portion of the internal surface of said mold;

comparing said signal from the mold with a predetermined range of values of temperature known to yield good quality castings in the mold when the representative portion thereof is in such temperature range; and filling said mold with liquid aluminum alloy only after the value of said temperature signal falls within said predetermined range of values.

* * * * *